United States Patent [19]

Dehne

[11] Patent Number: 4,873,831

[45] Date of Patent: Oct. 17, 1989

[54] CRYOGENIC REFRIGERATOR EMPLOYING COUNTERFLOW PASSAGEWAYS

[75] Inventor: Axel G. Dehne, Palos Verdes, Calif.

[73] Assignee: Hughes Aircraft Company, Los Angeles, Calif.

[21] Appl. No.: 329,043

[22] Filed: Mar. 27, 1989

[51] Int. Cl.[4] ..... F25B 9/00

[52] U.S. Cl. ..... 62/6; 62/51.2; 62/513

[58] Field of Search ..... 60/517, 520; 62/6, 51.2, 62/113, 513

[56] References Cited

U.S. PATENT DOCUMENTS

| | | | |
|---|---|---|---|
| 3,566,615 | 3/1971 | Roeder, Jr. | 62/513 |
| 3,952,543 | 4/1976 | Buller | 62/51.2 |
| 4,367,625 | 1/1983 | Vitale | 60/520 |
| 4,462,212 | 7/1984 | Knoos | 62/6 |
| 4,570,445 | 2/1986 | Ishibashi et al. | 62/6 |

*Primary Examiner*—Ronald C. Capossela

*Attorney, Agent, or Firm*—Terje Gudmestad

[57] ABSTRACT

A cryogenic refrigerator is disclosed having an expander piston reciprocally mounted within a fluid-tight housing. High pressure gas is supplied to a variable cold volume at one end of the piston through a passageway in the piston when the variable cold volume is at its minimum. Differential forces on the opposite end of the piston cause the piston to move, thereby enlarging the variable cold volume. The expanded cooled gas in the variable volume is vented out through the piston passageway which has been moved into fluid communication with a venting conduit when the variable volume is at its maximum. A heat exchanger operatively disposed between the gas supply and venting conduit allows the cold venting gas to cool the incoming high pressure gas. The cycle of operation employs isothermal expansion for obtaining cooling with a theoretical efficiency equal to that of a Carnot cycle thus; the refrigerator is more efficient than those using a Joule-Thompson cycle and is not limited to any specific refrigeration temperature (e.g., the boiling temperature of the working fluid).

13 Claims, 1 Drawing Sheet

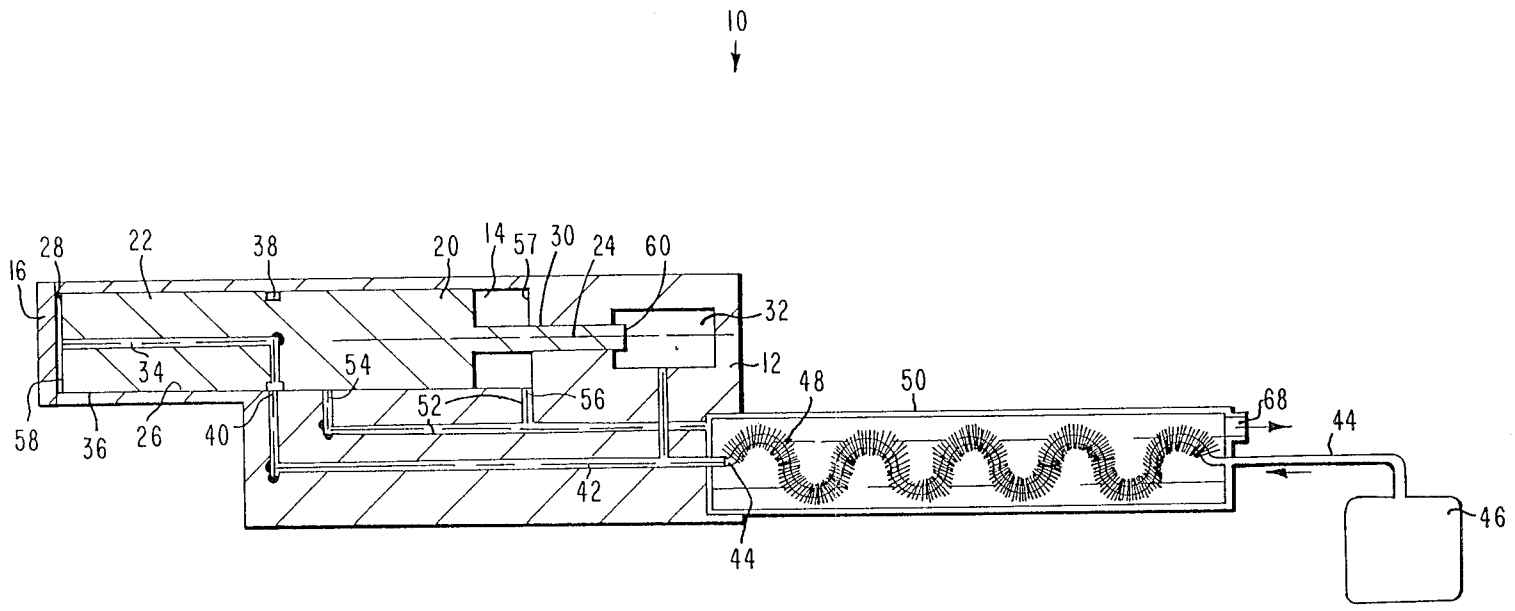
10
46
44
68
50
48
32
12
44
60
24
30
57
14
20
56
42
52
54
38
40
22
34
26
36
28
16
58

CRYOGENIC REFRIGERATOR EMPLOYING COUNTERFLOW PASSAGEWAYS

BACKGROUND OF THE INVENTION

1. Field of the Invention

This invention relates generally to open cycle refrigerators and more particularly to cryogenic coolers which employ expander pistons with counterflow passageways.

2. Description of Related Art

Over the past several decades, compact cryogenic refrigerators have been developed to give cryogenic temperatures from about 8° K. to 150° K. One conventional refrigeration arrangement is the Joule-Thompson refrigerator. In a Joule-Thompson refrigerator, incoming compressed gas from a source of compressed as such as a storage bottle passes through a counterflow heat exchanger to an expansion valve. As the gas passes through the expansion valve it is cooled and liquefied. The liquid is collected in a container. The liquid draws heat through the container from a source to be cooled. The heated liquid evaporates and is channeled through the counterflow heat exchanger and ultimately dumped into the atmosphere. As the evaporated liquid passes through the heat exchanger, it picks up additional heat from the incoming compressed gas, thereby precooling the incoming gas. While the Joule-Thompson refrigerator itself is somewhat compact it must be supported by a relatively high pressure gas source. This, coupled with the fact that the Joule-Thompson cycle is irreversible and inherently inefficient, necessitates a large gas storage volume. In applications where volume and weight are critical, the Joule-Thompson refrigerator is disadvantageously large and heavy.

Another conventional refrigeration device employing the Solvay cycle includes an expander piston containing a regenerative heat exchanger. While this cycle is typically used in a closed cycle manner (where the venting gas is recompressed), it can also be used in an open cycle manner (where the venting gas is dumped into the atmosphere). This technique allows operation with a compressed gas source and lends itself for rapid cooldown applications due to high flow capability during cooldown in a similar manner as the Joule-Thompson cycle. In such an application, the piston is located within a fluid-tight enclosed chamber, and forms a cold volume at one end of the chamber. In operation, fluid passes through the regenerator to the cold chamber and back through the regenerator whereby the piston reciprocates and the open cycle Solvay refrigeration cycle is accomplished. A drawback of open cycle refrigerators which employ regenerative heat exchangers is that a portion of the gas is prressurized and vented within the regenerator chamber without being used in the expansion process. The Solvay refrigeration arrangement is therefore inherently inefficient.

Today, smaller and smaller cryogenic refrigerators are being demanded to meet size and weight requirements desired by both military and commercial users. Furthermore, as miniature refrigerators are increasingly used to cool electronic devices, high efficiency and fast cooldown rates are desired.

SUMMARY OF THE INVENTION

It is therefore an object of the present invention to provide a compact open cycle cryogenic refrigerator which provides cooling faster than closed cycle refrigerators generally available in the prior art.

It is another object of the present invention to provide a cryogenic refrigerator that is more compact and more efficient operating on less gas than Joule-Thompson refrigerators.

A cryogenic refrigerator according to the present invention includes an expander piston freely mounted within a fluid-tight housing. The expander piston separates the housing into at least two volumes, a variable cold volume and a drive chamber volume, the area of the piston facing the variable cold volume being greater than the area of the piston facing the drive volume. The expander piston has a passageway therethrough from the variable cold volume to a lateral surface of the piston. A gas supply source provides high pressure gas to the variable cold volume through this passageway when the variable cold volume is essentially at its minimum. When the piston has moved so that the variable cold volume is essentially at its maximum, the gas in the variable cold volume is vented out through the piston passageway which has been moved into fluid communication with a venting conduit. A heat exchanger is thermally coupled between the gas supply source and the venting conduit to exchange heat therebetween.

Other and further objects, advantages and characteristic features of the present invention will become readily apparent from the following detailed description of a preferred embodiment of the invention when taken in conjunction with the drawings.

BRIEF DESCRIPTION OF THE DRAWINGS

The sole FIGURE is a longitudinal-sectional view of a cryogenic refrigerator in accordance with the invention.

DETAILED DESCRIPTION OF THE INVENTION

Referring now with greater particularity to the FIGURE, a cryogenic refrigerator 10 is shown having a fluid-tight housing 12 with an elongated cylindrically-shaped chamber 14 therein. End cap 16 seals the cold end of the elongated chamber, typically being affixed to the housing 12 by brazing, for example. End cap 16 is typically made of material which has a high thermal conductivity at the refrigeration temperature. Devices to be refrigerated, such as electronic sensors, may be thermally attached to the end cap 16.

Within the elongated chamber 14 is an expander piston 20 which is freely mounted. The expander piston 20 has a larger diameter portion 22 and a smaller diameter portion 24. The large diameter portion 22 forms a close fit with the inner annular wall 26 of the elongated chamber 14, typically 30–40 millionth of an inch clearance therebetween, for example. The expander piston 20 forms a variable cold volume 28 at one end of the housing 12. The expander piston 20 is shown in its top dead center position with the variable cold volume 28 at about its minimum.

The smaller diameter portion 24 of the expander piston 20 extends through hole 30 into a drive volume chamber 32. This drive volume chamber 32 contains a constant pressurized gas which is partially responsible for the reciprocation of the expander piston 20. Other means may be employed to reciprocate the expander piston such as a mechanical centering spring, for example. The smaller diameter portion 24 may have a rubber bumper (not shown) securely attached to the end thereof to serve as a stop for the expander piston 20, acting to prevent hard impact at either end of the stroke. The larger diameter portion 22 of the expander piston 20 has a fluid flow passageway 34 therethrough, extending axially from the end 58 of the piston 20 adjacent to the variable cold volume 28 for preselected distance and then radially outwardly to lateral surface 36 of the piston 20. An annular groove 38 extends around the expander piston 20 in fluid communication with flow passageway 34. Passageway 34 may be a hole about 0.015 of an inch in diameter, for example.

A high pressure inlet port 40 is adapted to open into the annular groove 38 through housing 12 depending on the position of the piston 20. High pressure inlet port 40 is connected via passageway 42 in housing 12 to one end of a conduit 44 which may be spirally disposed within a vent tube 50. The other end of the conduit 44 is coupled to a source of pressurized gas 46. Passageway 42 also opens into the drive chamber volume 32 to connect it with pressurized gas source 46. The conduit 44 has fins 48, forming a finned tube heat exchanger 49. The spiral arrangement of the conduit fins 48 within the vent tube 50 insures that any gas passing through the vent tube 50 necessarily flows over the finned tube heat exchanger 49.

An exhaust passageway 52 in housing 12 has an outlet port 54 opening through the annular inner wall 26 of housing 12 into the elongated chamber 14 a predetermined distance from inlet port 40. Exhaust passageway has a second outlet port 56 which opens into elongated chamber 14 near the inner end wall 57 of the chamber 14, while prevents pressure build up in the volume behind the piston. The exhaust passageway 52 opens to the interior of the vent tube 50. Vent tube 50 has an opening 68 at the outer end which may communicate with the outside atmosphere.

In operation, when the expander piston 20 is at the location shown in the FIGURE (variable cold volume is at a minimum), high pressure gas from pressurized gas source 46 fills the variable cold volume 28, and also the drive volume chamber 32. Since the area of the end 58 of the expander piston 20 at the cold volume 28 is greater than the area at the end 60 of the smaller diameter portion 24 in the drive chamber volume 32, the expander piston 20 is moved to the right because of the force imbalance, thereby enlarging the cold volume 28. As the piston 20 moves the annular groove 38 is moved out of fluid communication with the inlet port 40, and the high pressure gas supply is thereby blocked. The expanding gas in the variable cold volume 28 is cooled by the expansion but draws some heat from the cold end cap 16. Eventually the groove 38 is moved into fluid communication with the housing exhaust passageway outlet port 54. The expanded gas then exhausts through the passageway 52 into the vent tube 50. The exhausted gas flows through the vent tube 50 past the finned tube heat exchanger 49 and exits therefrom through opening 68 into the atmosphere. As the exhaust gas passes over the finned tube heat exchanger 49 it draws heat from the high pressure gas in conduit 44, precooling it before it may enter the cold volume 28.

As the gas exhausts, the pressure in the variable cold volume 28 drops such that the force on the piston 20 in the drive chamber volume 32 is greater than that on end 58 of the piston 20. The piston 20 therefore moves to the left reducing the cold volume 28 until the groove 28 returns to a position in fluid communication with the high pressure inlet port 40. The cycle thereafter repeats itself.

Various modifications may be made to the above-described preferred embodiment without departing from the scope of the invention. Accordingly, it should be understood that although the invention has been shown and described for one particular embodiment, nevertheless various changes and modifications obvious to a person of ordinary skill in the artto which the invention pertains are deemed to lie within the spirit and scope of the invention as set forth in the following claims.

What is claimed is:

1. A cryogenic refrigerator comprising:

a fluid-tight housing;

a cylindrically-shaped piston freely mounted in said fluid-tight housing and separating said housing into a variable cold volume and a constant pressure chamber, the area of said piston facing said variable cold volume being greater than the area of said piston facing said constant pressure chamber, said piston having a fluid passageway therein extending from said variable cold volume to a location along its radial surface;

gas supply means for supplying high pressure gas to said variable cold volume when said variable cold volume is substantially at its minimum volume and for supplying high pressure gas to said constant pressure chamber;

gas exhaust means for venting cold gas from said variable cold volume when said variable cold volume is substantially at its maximum volume; and heat exchanger means thermally coupled to said gas supply means in the vicinity of said gas exhaust means for exchanging heat therebetween and to the surrounding environment.

2. The cryogenic refrigerator defined in claim 1 wherein said piston has an annular groove in fluid communication with said passageway.

3. The cryogenic refrigerator defined in claim 2 wherein said gas supply means includes a source of gas and a conduit coupled between said source of gas and said fluid tight housing.

4. The cryogenic refrigerator defined in claim 3 wherein said gas exhaust means includes vent tube means coupled to said fluid tight housing and enclosing said heat exchanger means.

5. The cryogenic refrigerator defined in claim 4 further including a member to be cooled thermally coupled to said housing adjacent said cold volume.

6. A cryogenic refrigerator comprising:

a fluid-tight tubular member having a chamber therein and a cold end;

a source of compressed gas for supplying pressurized gas.

a first conduit extending from said source of compressed gas to said chamber for discharging a stream of pressurized gas into said chamber;

a venting conduit coupled to said chamber for venting gas from said chamber;

an expander piston reciprocally mounted within said chamber and defining in conjunction with the walls of said chamber a variable volume adjacent to said cold end, said piston having a passageway therethrough between said variable volume and a lateral wall of said piston such that said variable volume will be in fluid communication with said gas supply means and said venting conduit at predetermined respective positions of said piston within said chamber;

a heat exchanger thermally coupled to said first conduit and said venting conduit for exchanging heat therebetween and the environment; and pressure response means for alternately reciprocating said piston to increase and decrease said variable volume.

7. The cryogenic refrigerator defined in claim 6 wherein said pressure response means includes a fluid-tight constant pressure chamber supplied with high pressure gas from said source of compressed gas, said expander piston being acted upon by the pressure in said constant pressure chamber.

8. The cryogenic refrigerator as defined in claim 7 wherein said piston has an annular groove in fluid communication with said passageway.

9. The cryogenic refrigerator as defined in claim 8 further including member to be cooled thermally attached to said tubular member adjacent said variable volume.

10. A cryogenic refrigerator comprising:

a fluid-tight housing a plurality of chambers adapted to be maintained at predetermined temperature levels within said housing;

an elongated cylindrically-shaped member reciprocally mounted within said housing for varying the volume of at least one of said plurality of chambers, said member having a passageway therethrough from said one variable volume chamber to a lateral wall of said cylindrically-shaped member;

gas supply means for supplying high pressure gas through said passageway to said one variable volume chamber when said member is in a first predetermined position;

gas venting means for venting expanded gas from said one variable volume chamber when said member is in a second predetermined position;

a heat exchnager thermally coupled to said gas supply means; and driving means for reciprocating said member such that said refrigerator is operated through a predetermined cycle.

11. The cryogenic refrigerator defined in claim 10 wherein said gas supply means is a source of compressed gas.

12. The cryogenic refrigerator defined in claim 10 further including a member to be cooled thermally attached to said fluid-tight housing adjacent said one variable volume chamber.

13. A cryogenic refrigerator comprising:

a fluid-tight housing having a bore-shaped chamber therein and a cold end;

a source of compressed gas for supplying pressurized gas;

inlet passageway means for coupling said source of compressed gas to said bore-shaped chamber;

venting passageway means coupled to said bore-shaped chamber for venting gas therefrom;

an expander piston reciprocally mounted within said housing and defining in conjunction with the walls of said chambers a variable volume at said cold end, said piston having a passageway therethrough between the variable volume and a lateral wall of said piston such that the variable volume will be in fluid communication with said source of compressed gas and said venting passageway, respectively, at predetermined respective positions of said expander piston within said bore-shaped chamber;

a heat exchanger thermally coupled to said inlet passageway means; and pressure response means for alternately reciprocating said piston to increase and decrease said variable volume.

* * * * *